US010642196B2

(12) United States Patent
Ueda et al.

(10) Patent No.: US 10,642,196 B2
(45) Date of Patent: May 5, 2020

(54) CLEANING DEVICE AND IMAGE FORMING APPARATUS THEREWITH

(71) Applicant: KYOCERA Document Solutions Inc., Osaka (JP)

(72) Inventors: Yoji Ueda, Osaka (JP); Yuji Kamiyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/451,875

(22) Filed: Jun. 25, 2019

(65) Prior Publication Data

US 2020/0057403 A1 Feb. 20, 2020

(30) Foreign Application Priority Data

Aug. 20, 2018 (JP) ..... 2018-153859

(51) Int. Cl.
*G03G 15/16* (2006.01)
*G03G 15/01* (2006.01)

(52) U.S. Cl.
CPC ..... *G03G 15/161* (2013.01); *G03G 15/0131* (2013.01)

(58) Field of Classification Search
CPC ..... G03G 15/161; G03G 21/005; G03G 21/0058; G03G 21/007; G03G 2215/1647; G03G 2215/1661; G03G 2221/0005
See application file for complete search history.

(56) References Cited

U.S. PATENT DOCUMENTS

2014/0153956 A1* 6/2014 Yonemoto ..... G03G 15/161 399/101
2017/0031301 A1 2/2017 Kikuchi

FOREIGN PATENT DOCUMENTS

JP 3635935 B2 1/2005
JP 2011039427 A * 2/2011
JP 2013-29715 A 2/2013
JP 2017-32642 A 2/2017
JP 2017-111269 A 6/2017

OTHER PUBLICATIONS

Extended European Search Report dated Jan. 21, 2020, issued by the European Patent Office in corresponding application EP 19182134.7.

* cited by examiner

*Primary Examiner* — Erika J Villaluna
(74) *Attorney, Agent, or Firm* — Stein IP, LLC

(57) ABSTRACT

A cleaning device has a housing where an opening and a toner storage portion are formed, a cleaning member arranged in the opening, a collection roller collecting toner attached to the cleaning member, a blade scraping off toner attached to the collection roller, a sheet member dividing between the toner storage portion and the opening, and a sealing member arranged to be in contact with the housing and both end parts of the outer circumferential surface of the collection roller in the axial direction. A first region having a predetermined surface roughness is formed in a middle part of the circumferential surface of the collection roller in the axial direction, and a second region having a lower surface roughness than the first region is formed next to both end parts of the first region in the axial direction.

6 Claims, 4 Drawing Sheets

CLEANING DEVICE AND IMAGE FORMING APPARATUS THEREWITH

INCORPORATION BY REFERENCE

This application is based upon and claims the benefit of priority from the corresponding Japanese Patent Application No. 2018-153859 filed on Aug. 20, 2018, the entire contents of which are incorporated herein by reference.

BACKGROUND

The present disclosure relates to a cleaning device that removes toner left unused on the surface of an image carrying member by use of a cleaning member, and to an image forming apparatus incorporating such a cleaning device.

Conventionally, there is known an image forming apparatus of an intermediate transferring type that includes an endless intermediate transfer belt rotated in a predetermined direction and a plurality of image forming portions arranged along the intermediate transfer belt and that, after primary transferring by sequentially superimposing toner images of different colors to the intermediate transfer belt by the image forming portions, secondarily transfers them to a recording medium.

In such an image forming apparatus of the intermediate transferring type, a belt cleaning device is provided which removes toner left unused on the intermediate transfer belt after secondary transferring. If the intermediate transfer belt has no elastic layer, a blade type construction is used in which toner is scraped off while a cleaning blade is pressed onto the surface of the intermediate transfer belt.

On the other hand, if the intermediate transfer belt has an elastic layer, a cleaning device is frequently used which includes, in a housing, a cleaning blush that collects toner left unused on the surface of the intermediate transfer belt mechanically and electrically, a collection roller that collects toner from the cleaning brush, a blade that scrapes off toner from the surface of the collection roller, and a conveying spiral that conveys toner scraped off the surface of the collection roller to a waste toner container.

For example, there is known a belt cleaning device having a sheet member that divides the interior of a housing into a cleaning brush side and a conveying spiral side. The sheet member keeps its tip-end part in contact with the collection roller on the upstream side of a blade that scrapes off toner from the surface of the collection roller, and thereby guides toner scraped off the surface of the collection roller by the blade to the conveying spiral side so as not to return the toner to the cleaning brush side (outside the housing).

In this belt cleaning device, the intermediate transfer belt and the collection roller are so configured that, during their initial use, their surface roughness degreases through great secular change. This helps archive both toner scraping performance of the blade from the collection roller and paper particle conveying performance of the collection roller.

There is also known a cleaning device including a collection roller of which the surface roughness in both end parts in the axial direction is higher than the surface roughness in the middle part in the axial direction. In this cleaning device, the collection roller is given a low surface roughness in a region (a middle part in the axial direction) where it frequently scrapes off toner and a high surface roughness in other regions (both end parts in the axial direction). As a result, it is possible to satisfactorily collect toner from the cleaning member with the collection roller and to reduce adhesion between the blade and the collection roller over the entire range in the axial direction.

SUMMARY

According to one aspect of the present disclosure, a cleaning device includes a housing, a cleaning member, a collection roller, a blade, a sheet member, and a sealing member, and removes toner left unused on the surface of an image carrying member. The housing has formed in it an opening that faces the image carrying member carrying a toner image and a toner storage portion that stores toner removed from the surface of the image carrying member. The cleaning member is arranged at a position opposite the image carrying member. The collection roller collects toner attached to the cleaning member. The blade scraps off toner attached to the collection roller while in contact with the collection roller on the downstream side of the cleaning member with respect to the rotation direction of the collection roller. The sheet member is arranged over the entire range of the collection roller in its longitudinal direction on the downstream side of the cleaning member and on the upstream side of the blade with respect to the rotation direction of the collection roller so as to divide between the toner storage portion and the opening. The sealing member is arranged so as to be in contact with the housing and both end parts of the circumferential surface of the collection roller in the axial direction, and prevents toner from leaking out of a gap between the housing and the collection roller. A first region having a predetermined surface roughness is formed in a middle part of the circumferential surface of the collection roller in the axial direction, and a second region having a lower surface roughness than the first region is formed next to both end parts of the first region in the axial direction.

Further features and advantages of the present disclosure will become apparent from the description of embodiments given below.

DETAILED DESCRIPTION

Figure 1:
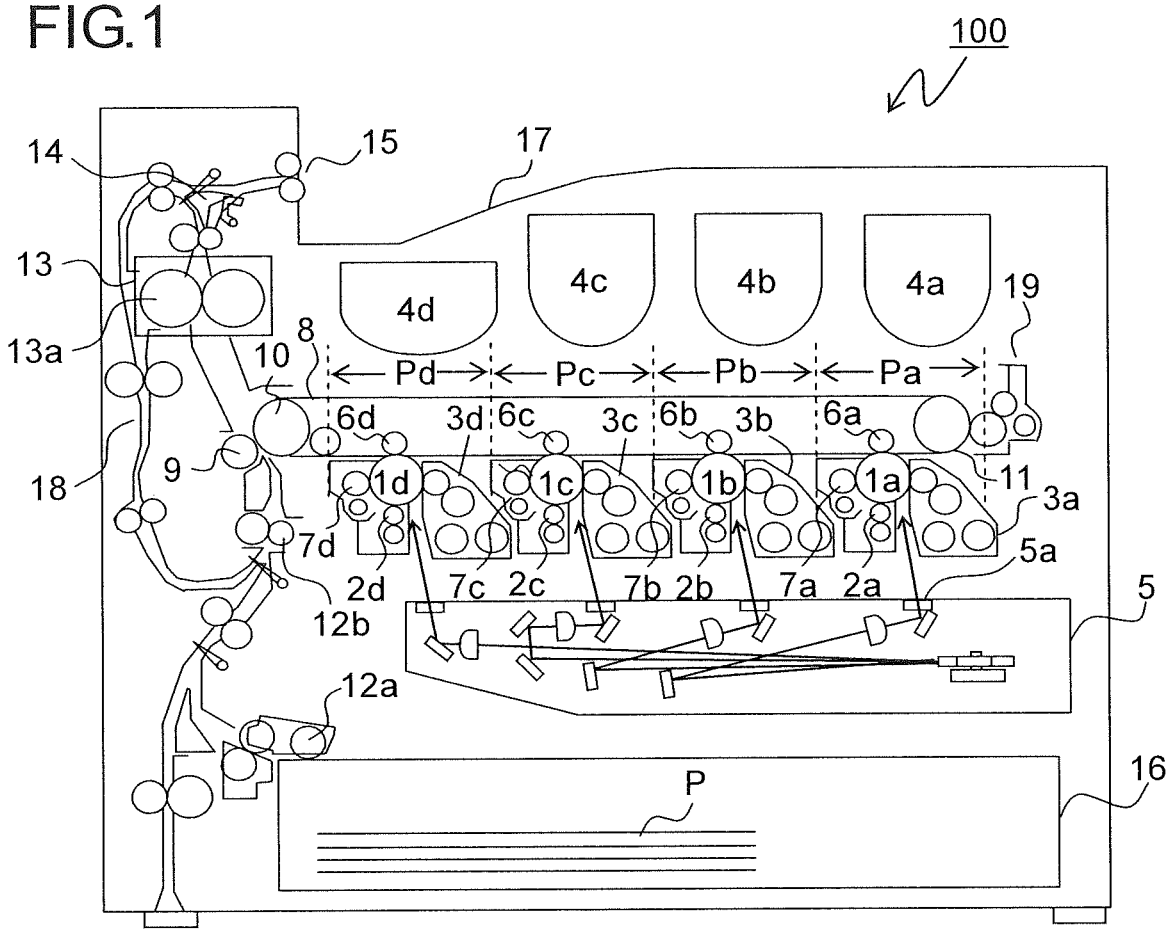
FIG. 1 is a schematic view showing an internal construction of an image forming apparatus incorporating a belt cleaning unit according to the present disclosure.
Figure 2:
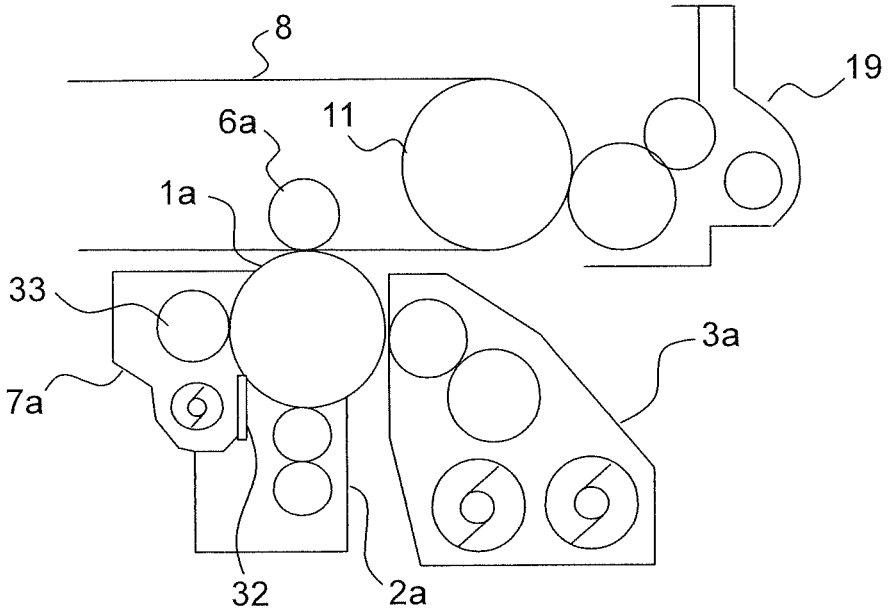
FIG. 2 is an enlarged view around an image forming portion in FIG. 1.

Hereinafter, with reference to the accompanying drawings, an embodiment of the present disclosure will be described. FIG. 1 is a schematic view showing a structure of an image forming apparatus 100 incorporating a belt cleaning unit 19 according to the present disclosure, and FIG. 2 is an enlarged view around an image forming portion Pa in FIG. 1.

The image forming apparatus 100 shown in FIG. 1 is what is called a tandem-type color printer and is configured as follows. In a main body of the image forming apparatus 100, four image forming portions Pa, Pb, Pc, and Pd are arranged in this order from the upstream side (in FIG. 1, the right side) in the conveying direction. These image forming portions Pa to Pd are provided to correspond to images of four different colors (cyan, magenta, yellow, and black) respectively, and sequentially form cyan, magenta, yellow, and black images respectively through the processes of charging, exposure, developing, and transferring.

In these image forming portions Pa to Pd, there are respectively arranged photosensitive drums 1*a*, 1*b*, 1*c*, and 1*d* that carry visible images (toner images) of the different colors, and an intermediate transfer belt 8 that rotates in the clockwise direction in FIG. 1 by the action of a driving means (not illustrated) is arranged next to the image forming portions Pa to Pd. Toner images formed on the these photosensitive drums 1*a* to 1*d* are sequentially transferred to the intermediate transfer belt 8 that moves while in contact with the photosensitive drums 1*a* to 1*d*, and then the toner images are transferred all at once to a transfer sheet P as an example of a recording medium by a secondary transfer roller 9. Then, the toner images are fixed to the transfer sheet P in a fixing portion 13, and the transfer sheet P is then discharged out of the image forming apparatus 100. An image formation process is performed with respect to the photosensitive drums 1*a* to 1*d* while these are rotated in the counter-clockwise direction in FIG. 1.

Transfer sheets P to which toner images are to be transferred are stored in a sheet feed cassette 16 arranged in a lower part of the main body of the image forming apparatus 100 and are conveyed via a sheet feed roller 12*a* and a registration roller pair 12*b* to the secondary transfer roller 9. As the intermediate transfer belt 8, a belt having no seam (seamless belt) is mainly used.

Now, the image forming portions Pa to Pd will be described. Below, a detailed description will be given of the image forming portion Pa; the image forming portions Pb to Pd have basically a similar structure, and thus no overlapping description will be repeated. As shown in FIG. 2, around the photosensitive drum 1*a*, along the drum rotation direction (in FIG. 1, the counter-clockwise direction), a charging device 2*a*, a developing device 3*a*, and a cleaning device 7*a* are arranged, and across the intermediate transfer belt 8, a primary transfer roller 6*a* is arranged. On the upstream side of the photosensitive drum 1*a* in the rotation direction of the intermediate transfer belt 8, a belt cleaning unit 19 is arranged opposite a tension roller 11 across the intermediate transfer belt 8.

Next, a procedure for image formation in the image forming apparatus 100 will be described. When an instruction to start image formation is fed in by a user, first the surfaces of the photosensitive drums 1*a* to 1*d* are electrostatically charged uniformly by charging devices 2*a* to 2*d*. Then, the surfaces of the photosensitive drums 1*a* to 1*d* are irradiated with beam light (laser light) emitted through light emitting windows 5*a* in an exposure unit 5, and thereby electrostatic latent images based on an image signal are formed on the photosensitive drums 1*a* to 1*d*, respectively. Developing devices 3*a* to 3*d* are charged with predetermined amounts of toner of different colors, namely cyan, magenta, yellow, and black, respectively. When the proportion of toner contained in the two-component developer stored in the developing devices 3*a* to 3*d* falls below a predetermined value through formation of toner images, which will be described later, toner is supplied from toner containers 4*a* to 4*d* to the developing devices 3*a* to 3*d*. The toner contained in the developer is fed from the developing devices 3*a* to 3*d* onto the photosensitive drums 1*a* to 1*d*, and electrostatically attaches to them, thereby forming toner images based on the electrostatic latent images formed by exposure to light from the exposure unit 5.

Then, an electric field with a predetermined transfer voltage is applied, by primary transfer rollers 6*a* to 6*d*, between the primary transfer rollers 6*a* to 6*d* and the photosensitive drums 1*a* to 1*d*, and thereby the cyan, magenta, yellow, and black toner images on the photosensitive drums 1*a* to 1*d* are primarily transferred to the intermediate transfer belt 8. These images of four colors are formed in a predetermined positional relationship previously determined to form a predetermined full-color image. Thereafter, in preparation for subsequent formation of new electrostatic latent images, toner remaining on the surfaces of the photosensitive drums 1*a* to 1*d* is removed by cleaning blades 32 and rubbing rollers 33 of cleaning devices 7*a* to 7*d*.

As a driving roller 10 rotates by the action of a belt driving motor (not illustrated), the intermediate transfer belt 8 starts to rotate in the clockwise direction; then, a transfer sheet P is conveyed with predetermined timing from the registration roller pair 12*b* to the secondary transfer roller 9 arranged next to the intermediate transfer belt 8 so that a full-color image is transferred to the transfer sheet P. The transfer sheet P having the toner images transferred to it is conveyed to the fixing portion 13. The toner remaining on the surface of the intermediate transfer belt 8 is removed by the belt cleaning unit 19.

The transfer sheet P conveyed to the fixing portion 13 is then heated and pressed by a fixing roller pair 13*a* so that the toner images are fixed to the surface of the transfer sheet P, thereby forming a predetermined full-color image. The transfer sheet P having the full-color image formed on it is distributed between different conveying directions by a branch portion 14 that branches into a plurality of directions. When an image is formed only on one side of a transfer sheet P, the transfer sheet P is discharged, as it is, onto a discharge tray 17 by a discharge roller pair 15.

On the other hand, when images are formed on both sides of a transfer sheet P, part of the transfer sheet P having passed through the fixing portion 13 is temporarily stuck out of the apparatus via the discharge roller pair 15. Thereafter, the discharge roller pair 15 is rotated in the reverse direction so that the transfer sheet P is distributed into a sheet conveying passage 18 by the branch portion 14; thus the transfer sheet P is, with the image side reversed, conveyed once again to the secondary transfer roller 9. Then, the next image formed on the intermediate transfer belt 8 is transferred by the secondary transfer roller 9 to the side of the transfer sheet P having no image formed on it. The transfer sheet P is conveyed to the fixing portion 13, where the toner image is fixed, and is then discharged onto the discharge tray 17 via the discharge roller pair 15.

Figure 3:
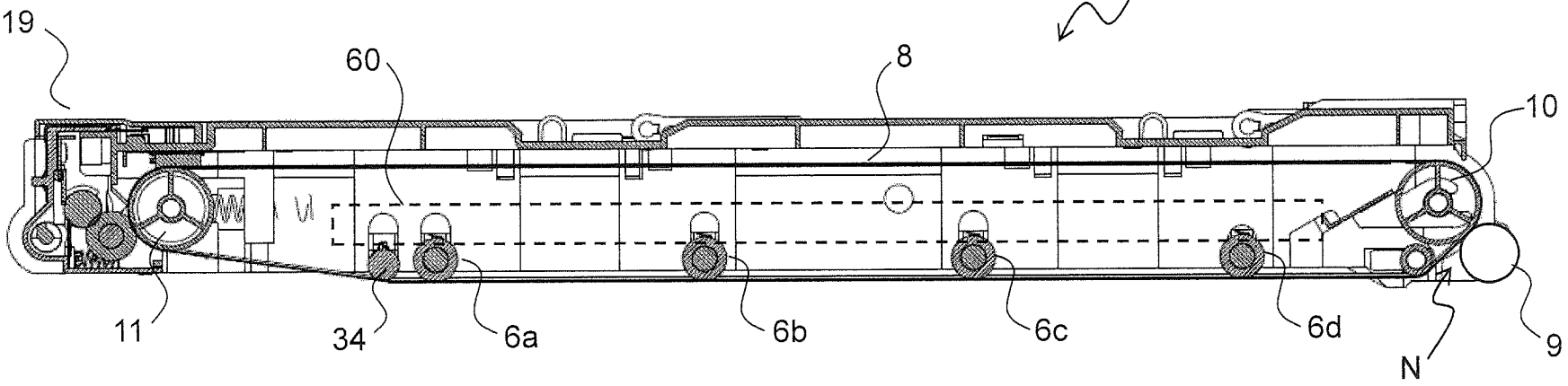
FIG. 3 is a side sectional view of an intermediate transfer unit incorporated in the image forming apparatus.

FIG. 3 is a side sectional view of an intermediate transfer unit 30 incorporated in the image forming apparatus 100. FIG. 3 shows the intermediate transfer unit 30 as seen from behind FIG. 1. As shown in FIG. 3, the intermediate transfer unit 30 includes the intermediate transfer belt 8 that is wound around the driving roller 10 on the downstream side and the tension roller 11 on the upstream side, the primary transfer rollers 6*a* to 6*d* that make contact with the photosensitive drums 1*a* to 1*d* via the intermediate transfer belt 8, and a pressure switching roller 34. At a position facing the tension roller 11, the belt cleaning unit 19 is arranged for removing toner that remains on the surface of the intermediate transfer belt 8. The structure of the belt cleaning unit 19 will be described in detail later.

The intermediate transfer unit 30 is provided with a roller contact-separation mechanism 60 that includes a pair of supporting members (not illustrated) supporting both end parts of the primary transfer rollers 6*a* to 6*d* and of a rotary shaft of the pressure switching roller 34 so as to be rotatable and movable perpendicularly (in FIG. 3, the up-down direction) to the movement direction of the intermediate transfer belt 8, and a driving means (not illustrated) reciprocating the primary transfer rollers 6*a* to 6*d* and the pressure switching roller 34 in the up-down direction. The roller contact-separation mechanism 60 is switchable among a color mode in which the four primary transfer rollers 6*a* to 6*d* are in pressed contact with the photosensitive drums 1*a* to 1*d* via the intermediate transfer belt 8, a monochrome mode in which only the primary transfer roller 6*d* is in pressed contact with the photosensitive drum 1*d* via the intermediate transfer belt 8, and a retracting mode in which the four primary transfer rollers 6*a* to 6*d* are all away from the intermediate transfer belt 8.

Specifically, the roller contact-separation mechanism 60 moves the pressure switching roller 34 upward so that the primary transfer rollers 6*a* to 6*d* move upward together with the intermediate transfer belt 8, and thereby the primary transfer rollers 6*a* to 6*d* move away from the photosensitive drums 1*a* to 1*d*. Here, the pressure switching roller 34 is arranged on the tension roller 11 side of the primary transfer roller 6*a*, and thus the bottom face (the contact face with the photosensitive drums 1*a* to 1*d*) of the intermediate transfer belt 8 swings up and down about the driving roller 10 side as a pivot. Thus, the distance between the intermediate transfer belt 8 and the photosensitive drums 1*a* to 1*d* is maximal on the photosensitive drum 1*a* side and is minimal on the photosensitive drum 1*d* side.

Figure 4:
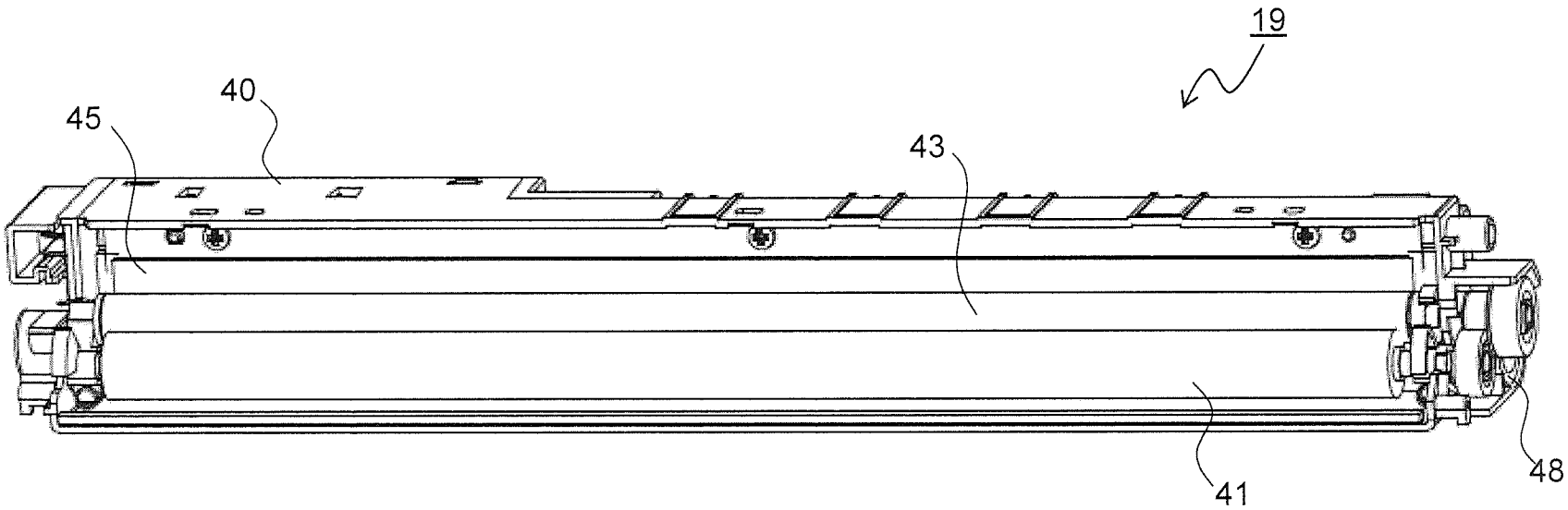
FIG. 4 is an exterior perspective view of the belt cleaning unit according to one embodiment of the present disclosure shown in FIG. 3.
Figure 5:
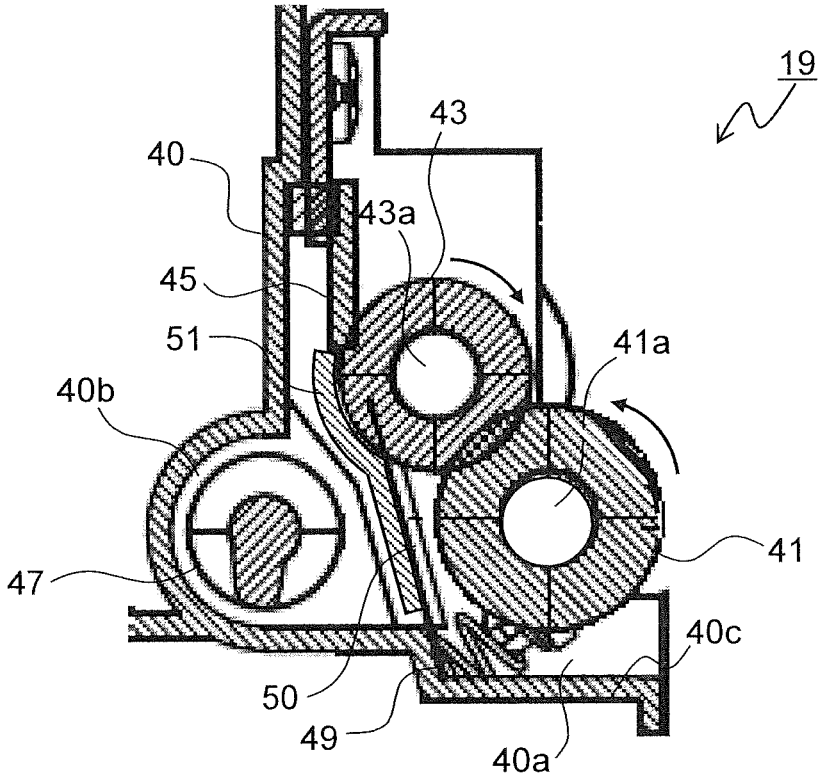
FIG. 5 is a side sectional view showing an internal construction of the belt cleaning unit according to the embodiment.
Figure 6:
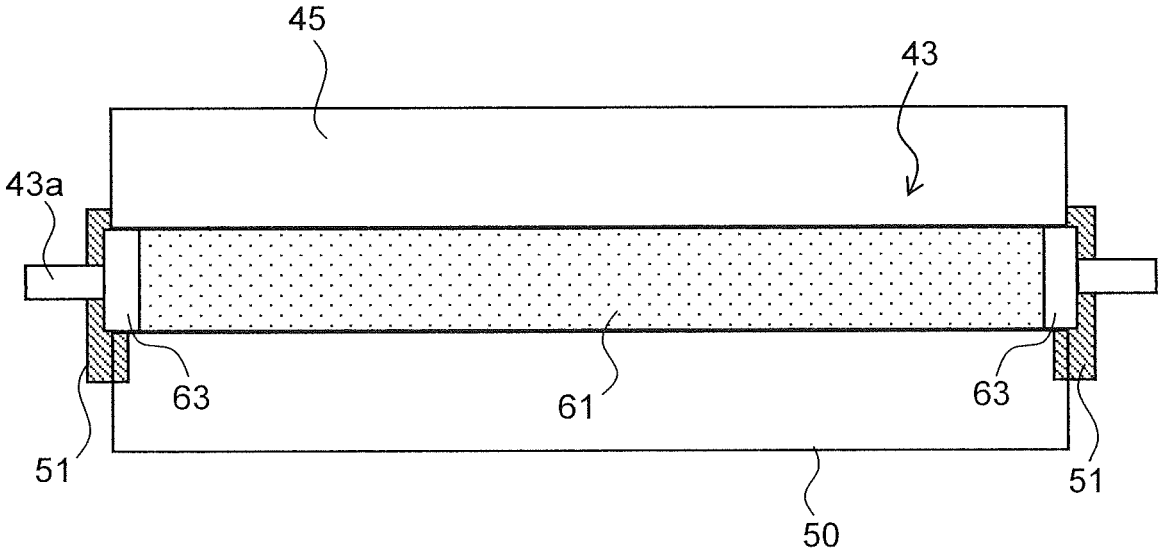
FIG. 6 is a side view of and around a collection roller of the belt cleaning unit as seen from the radial direction.

FIG. 4 is an exterior perspective view of the belt cleaning unit 19 according to one embodiment of the present disclosure shown in FIG. 3. FIG. 5 is a side sectional view showing an internal construction of the belt cleaning unit 19 according to the embodiment. FIG. 6 is a side view of and around a collection roller 43 of the belt cleaning unit 19 as seen from the radial direction (in FIG. 5, from the right side). The belt cleaning unit 19 includes, in a housing 40, a fur brush 41, a collection roller 43, a blade 45, and a conveying spiral 47. At one end of the housing 40, a driving input gear train 48 is arranged which feeds a driving force from a cleaning driving motor (not illustrated) to the fur brush 41, the collection roller 43, and the conveying spiral 47.

On the opening 40*a* side of the housing 40, the fur brush 41 is arranged opposite the tension roller 11 via the intermediate transfer belt 8. The fur brush 41 rotates in the counter direction (in FIG. 5, the counter-clockwise direction) with respect to the movement direction of the intermediate transfer belt 8, and thereby scrapes off foreign matter, such as toner and paper particles (hereinafter, referred to as toner and the like) that remain on the intermediate transfer belt 8. A brush part of the fur brush 41 that makes contact with the collection roller 43 is formed of electrically conductive fiber having an electrical resistance value of about 1 to 900 MΩ.

The collection roller 43 rotates in the opposite direction (in FIG. 5, the clockwise direction) to the fur brush 41 while in contact with the surface of the fur brush 41, and thereby collects toner and the like attached to the fur brush 41. To the collection roller 43, a cleaning voltage power supply (not illustrated) is connected, and when the intermediate transfer belt 8 is cleaned, a cleaning bias of the opposite polarity (here, negative polarity) to toner is applied. The tension roller 11 is grounded (earthed). As a result, the toner and the like that remain on the intermediate transfer belt 8 are collected electrically and mechanically by the brush part of the fur brush 41, and then move electrically to the collection roller 43.

The rotary shafts 41*a* and 43*a* of the fur brush 41 and the collection roller 43 are rotatably supported on the housing 40. The rotary shaft 41*a* of the fur brush 41 is biased in the upper rightward in FIG. 5 (in the direction of the tension roller 11) by a compression spring 49.

The blade 45 scrapes off the toner and the like collected by the collection roller 43 while in contact with the collection roller 43 on the downstream side of the fur brush 41 with respect to the rotation direction of the collection roller 43 and from the counter direction with respect to the movement direction of the surface of the collection roller 43 so that the collection roller 43 is cleaned. The conveying spiral 47 is arranged in a toner storage portion 40*b* in the housing 40 and conveys the toner and the like scraped off the collection roller 43 by the blade 45 to a waste toner container (not illustrated) outside the housing 40.

In the housing 40, a sheet member 50 is arranged over the entire range of the collection roller 43 in its longitudinal direction (the direction perpendicular to the plane of FIG. 5). The sheet member 50 is, for example, a member in a form of a sheet made of polyurethane or the like and is in contact with the collection roller 43 with a predetermined contact pressure. The contact pressure of the sheet member 50 needs to be set so as not to scrape off the toner attached to the collection roller 43 and not to return the toner and the like scraped off by the blade 45 to the collection roller 43 side.

Between both end parts of the collection roller 43 and the housing 40, sealing members 51 are arranged which are formed of an elastic material such as urethane foam or urethane sponge. As shown in FIG. 5, the sealing members 51 extend in an arc shape as seen in a side view so as to be in contact with the outer circumferential surface of the collection roller 43 in a range from the upstream side of the blade 45 to the downstream side of the sheet member 50 with respect to the rotation direction (in FIG. 5, the clockwise direction) of the collection roller 43, and are arranged so as to extend downward along the sheet member 50. The sealing member 51 is compressed by being held between the collection roller 43 and the housing 40; this prevents toner from entering a gap between the collection roller 43 and the housing 40 and prevents toner from leaking out of the housing 40.

As described earlier, when paper particles that have attached to the intermediate transfer belt 8 attach to the sheet member 50 via the fur brush 41 and the collection roller 43, a gap is formed between the collection roller 43 and the sheet member 50; thus toner and the like in the toner storage portion 40*b* flow back toward the opening 40*a* side and accumulate on the sheet member 50 and on the bottom face 40*c* of the housing 40. Then, if the accumulated toner and the like attach back to the fur brush 41 and move onto the intermediate transfer belt 8, dropping of toner may inconveniently result. Paper particles can be prevented from clogging between the collection roller 43 and the sheet member 50 by giving the collection roller 43 a high surface roughness and thereby enhancing the paper particle conveying performance of the collection roller 43.

However, when the collection roller 43 is given a high surface roughness, the toner scraping performance of the blade 45 lowers, and some toner slips though the blade 45. At the end part of the collection roller 43, the toner that has slipped through the blade 45 is repeatedly acted on by a pressure from the sealing member 51 to become agglomerated toner. When the agglomerated toner clogs between the collection roller 43 and the sheet member 50, as in the case where paper particles clog, waste toner flows from the toner storage portion 40*b* side back to the opening 40*a* side, and this results in attachment of the waste toner to the fur brush 41 and dropping of toner.

Here, in the belt cleaning unit 19 according to the embodiment, to prevent both clogging of paper particles between the collection roller 43 and the sheet member 50 and toner agglomeration at the end part of the collection roller 43, the surface roughness of the collection roller 43 is adjusted in the axial direction.

Specifically, as shown in FIG. 6, a first region 61 which has a predetermined surface roughness is formed in a middle part of the circumferential surface of the collection roller 43 in the axial direction. The first region 61 is a region where surface fine irregularities are formed on the surface of the collection roller 43, for example, by blasting.

If the surface roughness in the first region 61 is too high, toner is caught in concave parts, resulting in lower toner scraping performance of the blade 45. Since the collection roller 43 is not in direct contact with the intermediate transfer belt 8, even with lower toner scraping performance, no image defects occur immediately. However, if lower toner scraping performance persists, toner collecting performance from the fur brush 41 lowers; toner may then attach from the fur brush 41 back to the intermediate transfer belt 8. On the other end, if the surface roughness in the first region 61 is too low, paper particle conveying performance lowers; thus, paper particles are likely to clog the nip portion between the collection roller 43 and the sheet member 50.

As for the surface roughness in the first region 61, it is preferable that the ten-point average roughness Rz there be equal to or more than 4 μm but equal to or less than the average particle diameter of toner. With the surface roughness in the first region 61 within the above described range, it is possible to improve the effect of conveying paper particles in the middle part of the collection roller 43 in the axial direction and to minimize a drop in the toner scraping performance of the blade 45. In the present disclosure, the ten-point average roughness Rz is measured by the measurement method prescribed in JIS B0601 (1982).

Next to the both end parts of the first region 61 in the axial direction, a second region 63 is formed which has a lower surface roughness than the first region 61. The second region 63 is in direct contact with the sealing member 51 or is in contact with it via the sheet member 50. That is, the second region 63 is formed so as to overlap, in the axial direction (in FIG. 6, the left-right direction) of the collection roller 43, at least the contact part between the collection roller 43 and the sealing member 51. The second region 63 can be formed, for example, without blasting as is performed when the first region 61 is formed.

If the surface roughness in the second region 63 is too high, at the end part of the collection roller 43, as the collection roller 43 rotates, the toner that has slipped through the blade 45 passes through the sealing member 51 many times and thereby is repeatedly acted on by a pressure to become agglomerated toner. Thus, as for the surface roughness in the second region 63, it is preferable that the ten-point average roughness Rz there be equal to or less than 3 μm so that the toner attached to the surface of the collection roller 43 can be scraped off all at once by the blade 45.

With the above-described configuration, in the middle part of the collection roller 43 in the axial direction where a region of the intermediate transfer belt 8 to which paper particles have attached passes, the first region 61 is formed which has a high surface roughness and high paper particle conveying performance; it is thus possible to prevent paper particles from clogging the nip portion between the collection roller 43 and the sheet member 50. In the both end parts of the collection roller 43 in the axial direction which are acted on by a pressure from the sealing member 51, the second region 63 is formed which has a lower surface roughness than the first region 61 so as to be free from a drop in the toner scraping performance of the blade 45; it is thus possible to prevent toner agglomeration resulting from toner slipping.

The second region 63 is formed so as to overlap at least the contact part between the collection roller 43 and the sealing member 51, and this prevents the lowering of toner scraping performance in the both end parts of the collection roller 43 in the axial direction which are acted on by a pressure from the sealing member 51. It is thus possible to effectively prevent toner agglomeration in the both end parts of the collection roller 43 in the axial direction which are acted on by a pressure from the sealing member 51.

It is preferable that the second region 63 be formed outside the maximum width, in the axial direction, of the transfer sheet P passing through the secondary transfer nip portion N (see FIG. 3) in which the secondary transfer roller 9 and the driving roller 10 make contact with each other via the intermediate transfer belt 8. In this way, when the paper particles that have attached to the intermediate transfer belt 8 is collected by the collection roller 43 via the fur brush 41, the paper particles pass through the first region 61 having high conveying performance. It is thus possible to effectively prevent paper particles from clogging the nip portion between the sheet member 50 and the collection roller 43.

The present disclosure may be implemented in any other manner than in the embodiments described above, and allows for many modification without departure from the spirit of the present disclosure. Although, for example, the above-described embodiment deal with, as an example, the belt cleaning unit 19 having the fur brush 41, the present disclosure is applicable equally to a configuration using a cleaning roller instead of the fur brush 41.

Although the above-described embodiment deal with, as an example, the belt cleaning unit 19 removing toner that remains on the surface of the intermediate transfer belt 8 by use of the fur brush 41 (cleaning member) and the collection roller 43, for example, in a configuration in which the cleaning devices 7*a* to 7*d* removing toner that remains on the surface of the photosensitive drums 1*a* to 1*d* (image carrying member) are provided with a collection roller collecting toner that is attached to the rubbing roller 33 (cleaning member), as in the present disclosure, by adjusting the surface roughness of the collection roller, an effect similar to that in the present disclosure can be expected.

Needless to say, the present disclosure is applicable, not only to a tandem-type color printer as shown in FIG. 1, but also to various image forming apparatus using an intermediate transfer belt and a belt cleaning device, such as color copiers and color multifunction peripherals. Next, by way of practical examples, the effect of the present disclosure will be described more specially.

PRACTICAL EXAMPLES

The relationship of the surface roughness of the collection roller 43 with paper particle clogging and cleaning performance was studied. As a test machine, a color multifunction peripheral (an altered version of the model TASKalfa2552ci manufactured by Kyocera Document Solutions Inc.) shown in FIG. 1 was used. The belt cleaning unit 19 is fitted with one at a time of collection rollers 43 of which the surface had ten-point average roughnesses Rz of 1.0 μm, 3.0 μm, 4.1 μm, 5.6 μm, and 7.9 μm respectively, and the incidence of paper particle clogging between the collection roller 43 and the sheet member 50 and the incidence of cleaning failure on images were compared.

As developer, two-component developer were used which contained positively charging toner having an average particle diameter of 7 μm. Among the collection rollers 43, only for the one whose Rz was 3.0 μm, a roller made of SUM (sulfur composite free-cutting steel) and subjected to nickel plating treatment was used, and for the other, aluminum rollers subjected to alumite treatment were used.

In the tests, when 5000 sheets printed with a coverage rate 4% for each color were continuously printed, whether or not paper particle clogging or cleaning failure on images has occurred was visually checked. Table 1 shows the results of evaluation along with the ten-point average roughness Rz of the collection roller 43 used. Each ten-point average roughness Rz is an average value of the values measured at 12 points on the surface of the collection roller 43.

TABLE 1

| TEN-POINT AVERAGE ROUGHNESS Rz [μm] | PAPER PARTICLE CLOGGING | CLEANING FAILURE ON IMAGE |
|---|---|---|
| 1.0 | x | ○ |
| 3.0 | x | ○ |
| 4.1 | ○ | ○ |
| 5.6 | ○ | ○ |
| 7.9 | ○ | x |

Table 1 reveals the following. When the ten-point average roughness Rz of the collection roller 43 was equal to or less than 3.0 μm, paper particles clogged between the collection roller 43 and the sheet member 50. The reason is considered to be that, when the ten-point average roughness Rz of the collection roller 43 is low, paper particle conveying performance is insufficient.

When the surface roughness Rz of the collection roller 43 was 7.9 μm, cleaning failure on the image occurred. The reason is considered to be as follows. When the surface roughness Rz of the collection roller 43 was higher than the average particle diameter of toner, toner was caught in concave parts on the surface of the collection roller 43 so that the toner scraping performance of the blade 45 lowered; thus, toner collecting performance from the fur brush 41 to the collection roller 43 lowered, and toner attached from the fur brush 41 back to the intermediate transfer belt 8.

The above results confirm the following. With the surface roughness in the first region 61 of the collection roller 43 equal to or more than 4 μm but equal to or less than the average particle diameter of toner, it is possible, while maintaining the toner scraping performance of the blade 45, to prevent paper particles from clogging.

The lower the surface roughness Rz of the collection roller 43, the higher the toner scraping performance of the blade 45, and thus, when the surface roughness Rz of the collection roller 43 is equal to or less than 3.0 μm, the toner attached to the end part of the collection roller 43 can be scraped off all at once by the blade 45. Thus, with the surface roughness Rz in the second region 63 of the collection roller 43 equal to or less than 3.0 μm, it is possible to effectively prevent toner agglomeration resulting from the toner that has slipped through the blade 45 passing through the sealing member 51 many times.

The present disclosure finds application in cleaning devices that remove toner left unused on the surface of an image carrying member by use of a cleaning member. Based on the present disclosure, it is possible to provide a cleaning device that prevents paper particles from clogging the nip portion between a collection roller collecting waste toner from a cleaning member and a sheet member and that can effectively prevent toner agglomeration at the end part of the collection roller.

What is claimed is:

1. A cleaning device comprising, a housing that is formed therein an opening facing an image carrying member carrying a toner image and a toner storage portion storing toner removed from a surface of the image carrying member;

a cleaning member that is arranged at a position the image carrying member;

a collection roller that collects toner attached to the cleaning member;

a blade that scrapes off toner attached to the collection roller while in contact with the collection roller, on a downstream side of the cleaning member with respect to a rotation direction of the collection roller;

a sheet member that is arranged over an entire range of the collection roller in a longitudinal direction thereof on the downstream side of the cleaning member and on an upstream side of the blade with respect to the rotation direction of the collection roller so as to divide between the toner storage portion and the opening; and a sealing member that is arranged so as to be in contact with the housing and both end parts of a circumferential surface of the collection roller in an axial direction and that prevents toner from leaking out of a gap between the housing and the collection roller, the cleaning device removing toner left unused on the surface of the image carrying member, wherein a first region that has a predetermined surface roughness is formed in a middle part of the circumferential surface of the collection roller in the axial direction, a second region that has a lower surface roughness than the first region is formed next to both end parts of the first region in the axial direction, and the second region is formed so as to extend, in the axial direction of the collection roller, at least past a border of a contact part between the collection roller and the sealing member toward a middle part of the collection roller in the axial direction.

2. The cleaning device according to claim 1, wherein the second region is formed outside the maximum width, in the axial direction of the collection roller, of a recording medium to which the toner image carried on the image carrying member is transferred.

3. The cleaning device according to claim 1, wherein

The surface roughness in the first region is, in terms of ten-point average roughness Rz, equal to or more than 4 μm but equal to or less than an average particle diameter of the toner.

4. The cleaning device according to claim 1, wherein the surface roughness in the second region is, in term of ten-point average roughness Rz, equal to or less than 3 μm.

5. The cleaning device according to claim 1, wherein the sealing member extends in an arc shape as seen in a side view so as to be in contact with an outer circumferential surface of the collection roller in a range from the upstream side of the blade to a downstream side of the sheet member with respect to the rotation direction of the collection roller, and is arranged so as to extend downward along the sheet member.

6. An image forming apparatus comprising:

a plurality of image forming portions that form images of different colors;

an intermediate transfer unit that includes an endless intermediate transfer belt moving along the image forming portion and a plurality of primary transfer members arranged opposite photosensitive drums arranged in the image forming portions across the intermediate transfer belt and transferring a toner image formed on the photosensitive drums to the intermediate transfer belt;

a secondary transfer member that secondarily transfers a toner image primarily transferred to the intermediate transfer belt to a recording medium; and the cleaning device according to claim 1 that removes toner left unused on the surface of the intermediate transfer belt.

* * * * *